US008800607B2

(12) United States Patent
Omar et al.

(10) Patent No.: US 8,800,607 B2
(45) Date of Patent: Aug. 12, 2014

(54) METHOD AND SYSTEM FOR OFFSHORE EXPORT AND OFFLOADING OF LPG

(75) Inventors: Ahmed F. Omar, Katy, TX (US); Rick Marshall, Houston, TX (US); Arif Shipchandler, Katy, TX (US); Miguel Ruiz, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 552 days.

(21) Appl. No.: 12/794,378

(22) Filed: Jun. 4, 2010

(65) Prior Publication Data

US 2011/0299960 A1 Dec. 8, 2011

(51) Int. Cl.
*B65B 1/20* (2006.01)
*B63B 22/02* (2006.01)

(52) U.S. Cl.
CPC ..... *B63B 22/021* (2013.01)
USPC ..... 141/11; 141/382; 141/387; 114/230.13; 441/4; 441/5

(58) Field of Classification Search
USPC ..... 141/2, 11, 231, 382, 387; 114/230.13; 441/4, 5; 62/50.1
See application file for complete search history.

(56) References Cited

U.S. PATENT DOCUMENTS 4,637,335 A * 1/1987 Pollack ..... 114/230.12
6,199,595 B1 * 3/2001 Baker ..... 138/149
6,558,215 B1 * 5/2003 Boatman ..... 441/5
6,672,391 B2 * 1/2004 Anderson et al. ..... 166/357
6,685,519 B1 * 2/2004 Bech et al. ..... 441/4
7,210,530 B2 * 5/2007 Lush et al. ..... 166/357
7,470,163 B2 * 12/2008 Lokken et al. ..... 441/3
7,836,840 B2 * 11/2010 Ehrhardt et al. ..... 114/230.13
2004/0238176 A1 * 12/2004 Appleford et al. ..... 166/353

OTHER PUBLICATIONS

Bonjour, E.L and Simon, J.M., "Offshore Refrigerated LPG Loading/Unloading Terminal Using a CALM Buoy", SPE 13731-MS; Middle East Oil Technical Conference and Exhibition, Mar. 11-14, 1985, Bahrain, 1 page.
Chiu, Chen-Hwa and Quillen, Doug, "Developing Offshore LNG Facilities" (2008) www.pipelineandgastechnology.com/Construction/EngineeringDesign/item32782, 9 pages.

* cited by examiner

*Primary Examiner* — Timothy L Maust
(74) *Attorney, Agent, or Firm* — Melissa M. Hayworth; Melissa Patangia; E. Joseph Gess

(57) ABSTRACT

A process and system for directly exporting liquefied petroleum gas (LPG) from an offshore location is disclosed. The process comprises (a) obtaining a mixture comprising oil and natural gas from a subsea well; (b) separating LPG from the mixture comprising oil and natural gas at a floating or fixed offshore processing facility; (c) offloading the LPG directly from the floating or fixed offshore processing facility via subsea offloading risers and at least one subsea offloading flowline connecting the processing facility to a floating or fixed offshore transfer station; and (d) transferring the LPG to an export tanker at the transfer station. The system comprises a floating or fixed offshore processing facility, a floating or fixed offshore transfer station, and a set of subsea offloading transfer lines connecting the processing facility and the transfer station.

14 Claims, 2 Drawing Sheets

METHOD AND SYSTEM FOR OFFSHORE EXPORT AND OFFLOADING OF LPG

FIELD OF THE INVENTION

The present application relates to a method and system for directly exporting liquefied petroleum gas (LPG) from an offshore location that eliminates the need for an intermediate floating production, storage, and offloading (FPSO) unit.

BACKGROUND OF THE INVENTION

As the oil and gas industry moves offshore into deeper waters, more gas will also be discovered. Offshore production of LPG is the natural extension of offshore oil production. Some of the gas will be associated with gas produced with oil and other discoveries will be gas reservoirs. Demand for LPG is rising, particularly in the residential and commercial sectors. The use of cleaner liquid and gaseous fuels is expected to continue to increase as populations grow and total demand for energy rises proportionally. As oil and gas prices rise, the economics of liquefied gas improves and results in more demand for LPG.

LPG is a mixture of ethane, propane, and butane and may contain minor quantities of other light condensable hydrocarbons associated with production of oil and gas. At ambient temperature and pressure, LPG exists as a gas, but it can be cooled and/or pressurized to provide a liquid, which facilitates storage and transportation. LPC can be liquefied at pressures between 100 psig and 150 psig at ambient temperatures.

The current state of the art proposes to extract LPG from natural gas and store it on intermediate FPSO units or in elaborate and expensive tanks built in the processing facility prior to offloading it to export carriers. In addition, LPG has been produced at offshore terminals and transported to LPG storage/processing facilities onshore by means of a subsea pipeline to the onshore facility. As such, these facilities need to be deployed close to the shoreline.

Offshore collection, transfer, and transportation of LPG present many challenges. There are many aspects of offshore LPG production that are in need of improvement to make the process commercially viable.

SUMMARY OF THE INVENTION

As described herein, a method and system for directly exporting LPG from an offshore location without requiring an intermediate floating production, storage, and offloading (FPSO) unit are provided.

In one embodiment, a method of directly exporting liquefied petroleum gas (LPG) from an offshore location comprises (a) obtaining a mixture comprising oil and natural gas from a subsea well; (b) separating LPG from the mixture comprising oil and natural gas at a floating or fixed offshore processing facility; (c) offloading the LPG directly from the floating or fixed offshore processing facility via subsea offloading risers and at least one subsea offloading flowline connecting the processing facility to a floating or fixed offshore transfer station; and (d) transferring the LPG to an export tanker at the transfer station. In this method an intermediate floating production, storage, and offloading (FPSO) unit for the LPG is not required.

In another embodiment, a system for directly exporting liquefied petroleum gas (LPG) from an offshore location comprises a floating or fixed offshore processing facility, a floating or fixed offshore transfer station, and a set of subsea offloading transfer lines connecting the processing facility and the transfer station. The set of subsea offloading transfer lines comprises at least two subsea offloading risers and at least one subsea offloading flowline. In this system, no intermediate floating production, storage, and offloading (FPSO) unit for the LPG is required.

DETAILED DESCRIPTION OF THE INVENTION

Definitions

Figure 1:
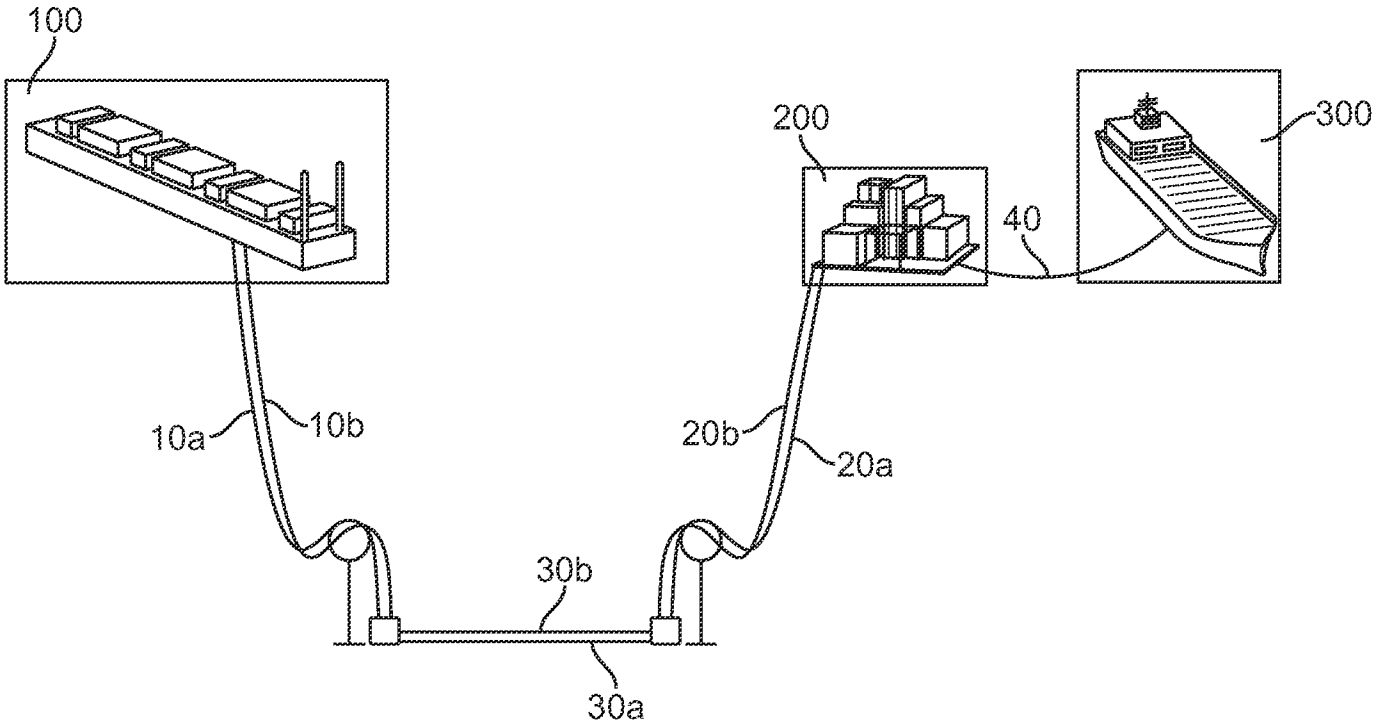
FIG. 1 illustrates an embodiment of the method and system utilizing refrigerated LPG. In this embodiment, offloading the LPG comprises delivering the LPG from the processing facility through a first set of subsea offloading risers down to a seabed, through a set of subsea offloading flowlines at the seabed, and up through a second set of subsea offloading risers to the transfer station. In this embodiment, the LPG can be circulated in the subsea offloading risers and the subsea offloading flowlines until the export carrier arrives at the transfer station. In this embodiment an intermediate FPSO unit for the LPG is not utilized.

In accordance with this detailed description, the following abbreviations and definitions apply. It must be noted that as used herein, the singular forms "a", "an", and "the" include plural referents unless the context clearly dictates otherwise. Thus, for example, reference to "flowline" includes a plurality of such.

Unless otherwise stated, the following terms used in the specification and claims have the meanings given below:

"LPG" is liquefied petroleum gas and is a mixture of ethane, propane, and butane, which may contain minor quantities of other light condensable hydrocarbons associated with production of oil and gas. At ambient temperature and pressure, LPG exists as a gas, but it can be cooled and/or pressurized to provide a liquid, which facilitates storage and transportation.

"FPSO" means a floating production, storage, and offloading unit.

"Remote" means a location that is at least 100, more preferably 500 miles, offshore.

"Subsea" means at a depth beneath the surface of the water.

"Directly" in the context of transporting/exporting LPG as described herein means that the LPG is exported from an offshore facility (i.e., a facility at an offshore location that receives LPG from a subsea well) to an export carrier without requiring storage in an intermediate FPSO unit.

"Optional" or "optionally" means that the subsequently described event or circumstance may, but need not, occur, and that the description includes instances where the event or circumstance occurs and instances in which it does not.

The present application provides a method and a system whereby produced LPG in a FPSO or another floating or fixed offshore processing facility is continuously exported as it is produced, rather than storing it prior to export in the production facility, at a nearby production facility, or in another floating or fixed facility, such as another FPSO, built exclusively for that purpose. Accordingly, with the present method and system, an intermediate storage facility is not required and can be eliminated. Thus, the present method and system reduce the risk and cost of the facilities associated with production.

The present method and system also do not require an onshore storage facility for storing LPG before the LPG is transferred from transfer station to e.g., an export tanker. Accordingly, the present method and system can be employed in deepwater and in areas remote from onshore facilities. Accordingly, with the present method and system, remote reservoirs can be accessed for production.

The present innovative method directly exports liquefied petroleum gas (LPG) from an offshore location eliminating the need for storage in another independent FPSO. In the present method a mixture comprising oil and natural gas is obtained from a subsea well. Because an onshore storage facility also is not utilized, this subsea well can be in deep water and/or in an area remove from the shoreline, which allows for development of additional, previously inaccessible reservoirs. The mixture of oil and natural gas is obtained at a floating or fixed offshore processing facility and the mixture of oil and natural gas is separated to provide LPG. The mixture of oil and natural gas is separated at the floating or fixed offshore processing facility by conventional means well known to those of skill in the art for oil and gas production.

The LPG can be continuously offloaded directly to an export carrier as it is produced. Offloading is performed by subsea offloading risers and flowlines connecting the processing facility to a floating or fixed offshore transfer station. The offloading flowlines can be located on the seabed or suspended floating in the water at a depth beneath the surface. The deeper the offloading flowlines are located, the more the flowlines can take advantage of the cool seawater temperature. The LPG is transferred to an export tanker at the transfer station. The present method and system do not require a separate FPSO unit for storage of the LPG prior to transfer to an export carrier.

In marine transportation, LPG is typically transported by dedicated vessels or tankers suitable for carrying pressurized, semi-pressurized, or refrigerated LPG. All three types of export vessels or tankers may be used in the present method and system. In the present method and system, the tankers are moored to the transfer station, for example by using floating hoses. Accordingly, in the present method and system, virtually any size vessel (length and width) can be utilized.

In one embodiment, the offloading of the LPG from the processing facility comprises delivering the LPG from the processing facility to a buoy located at a distance from the processing facility. The buoy may be a catenary anchor leg mooring (CALM) buoy and in this embodiment the buoy is the transfer station for transferring the LPG to the export tanker. Offloading is performed by subsea offloading risers and flowlines connecting the production facility to the buoy located at a safe distance from the processing facility. At the buoy, the LPG can be transferred to export carriers moored to the buoy using floating hoses.

In one embodiment, LPG can be exported as refrigerated LPG by cooling it at the processing facility to a liquid. The embodiment of this method and system is illustrated in FIG. 1.

In this embodiment, the offloading risers and flowlines typically need to be highly insulated to prevent heat ingress to the fluid to ensure that the LPG arrives at the transfer station and export carrier in liquid form at nearly atmospheric pressure. For example, the subsea offloading risers and flowlines may be either jacket or vacuum insulated. The offloading flowlines can be located at the seabed or suspended floating in the water at a depth beneath the surface. The deeper the offloading flowlines are located, the more the flowlines can take advantage of the cool seawater temperature.

In this embodiment a carrier suitable for refrigerated LPG is utilized. The carrier vessel will be suitable for carrying refrigerated LPG and will have a gas re-liquefaction system. The carrier vessel has a re-liquefaction unit to re-liquefy any gasified LPG that is produced in the offloading transfer lines during the offloading and transferring process and any gas that flashes out in the receiving tank of the carrier vessel after the LPG is transferred. Therefore, it is important to maintain a minimum U-value (overall thermal heat exchange coefficient) of the subsea offloading risers and flowlines system at all times over the field life to prevent or minimize gas evolution from the liquid refrigerated LPG. The re-liquefaction system in the export carrier has limited capacity and will not accept cargo if too much LPG is in the gas state.

The offloading system can take advantage of the cool seawater temperature at the seabed. With the use of average U-value of the whole offloading system taking advantage of this cool temperature, the offloading of the refrigerated LPG can be achieved using existing flexible pipeline technology with conventional insulation for the riser system and pipe-in-pipe technology with conventional cold environment applications (e.g., Aerogel, Cryogel, etc).

In this embodiment, the method and system do not utilize a separate FPSO unit for storage of the LPG prior to transfer to an export carrier.

In this embodiment, the LPG is condensed and refrigerated to liquid form after separation at the floating or fixed offshore processing facility (100). Sets of offloading risers (10*a* and 10*b* and 20*a* and 20*b*) and a set of offloading flowlines on the seabed (30*a* and 30*b*) are utilized. In this embodiment, the liquefied LPG is circulated from the floating or fixed offshore processing facility (100) through subsea offloading riser (10*a*) to offloading flowline (30*a*) at the seabed, up through subsea offloading riser (20*a*) to the transfer station (200). Until an export carrier (300) arrives at the transfer station for receiving LPG, the LPG can be circulated in the set of subsea offloading risers and subsea offloading flowlines by circulating the LPG down subsea offloading riser (10*a*) to offloading flowline (30*a*) at the seabed, up through offloading riser (20*a*), back down through offloading riser (20*b*), through offloading flowline (30*b*) at the seabed, up through offloading riser (10*b*), and then back down through subsea offloading riser (10*a*) to start the circulation process again until arrival of an export carrier (300) at the transfer station (200). The LPG can be continually circulated, as such, taking advantage of the cool seawater temperature at the seabed until arrival of an export carrier (300).

When an export carrier (300) arrives at the transfer station (200), the liquefied LPG can be delivered to the export carrier (300) through a suitable transfer hose (40). In this embodiment, the transfer station can be a buoy. The transfer hose can be floating on or close to the surface of the water or at a depth below the surface.

In this embodiment, the temperature of the LPG in the subsea offloading risers and the subsea offloading flowlines is between about 5° F. and about 45° F. The pressure of the LPG in the subsea offloading risers and the subsea offloading flowline is between about 50 psia and about 350 psia.

In this embodiment, the system comprises a floating or fixed offshore processing facility (100), a floating or fixed offshore transfer station (200), a set of subsea offloading transfer lines (10*a* and 10*b*, 20*a* and 20*b*, and 30*a* and 30*b*) connecting the processing facility and the transfer station. The set of subsea offloading transfer lines comprises at least two subsea offloading risers and at least one subsea offloading flowline connecting the processing facility to the transfer station. As illustrated, each set of subsea offloading transfer lines comprises at least one subsea offloading flowline (30*a*) connected between and in fluid communication with a first subsea offloading riser (10*a*) and a second subsea offloading riser (20*a*), the first subsea offloading riser (10*a*) connected to and in fluid communication with the processing facility and the second subsea offloading riser (20*a*) connected to and in fluid communication with the transfer station.

In an embodiment where the LPG is continuously circulated until the export carrier arrives at the transfer station, the set of offloading transfer lines comprises two sets of subsea offloading risers (10*a* and 10*b* and 20*a* and 20*b*) and a set of subsea offloading flowlines on the seabed (30*a* and 30*b*). In this embodiment, until an export carrier (300) arrives at the transfer station for receiving LPG, the LPG can be continuously circulated in the two sets of subsea offloading risers and the set of subsea offloading flowlines by circulating the LPG down subsea offloading riser (10*a*) to offloading flowline (30*a*) at the seabed, up through subsea offloading riser (20*a*), back down through subsea offloading riser (20*b*), through the subsea offloading flowline (30*b*) at the seabed, up through subsea offloading riser (10*b*), and then back down through subsea offloading riser (10*a*) to start the circulation process again until arrival of an export carrier at the transfer station. The LPG can be continually circulated as such taking advantage of the cool seawater temperature at the seabed until arrival of an export carrier (300).

In this embodiment, the LPG is exported directly from an offshore location without utilizing a separate FPSO unit.

Figure 2:
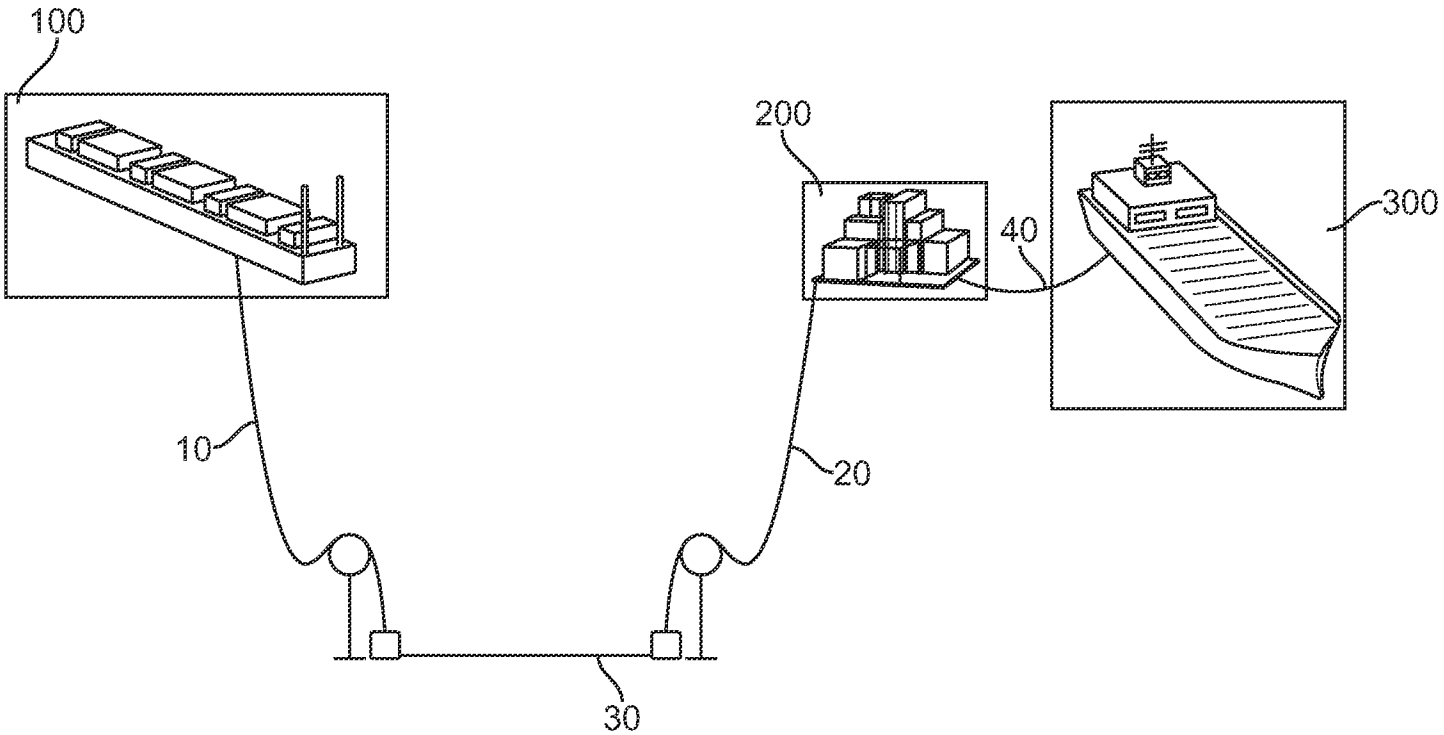
FIG. 2 illustrates an embodiment of the method and system utilizing pressurized LPG. In this embodiment, offloading the LPG from the processing facility comprises delivering the LPG from the processing facility to a buoy located at a distance from the processing facility utilizing subsea offloading risers and offloading flowline.

The LPG also can be exported in a pressurized form to keep it liquid at ambient temperature. The embodiment of this method and system is illustrated in FIG. 2.

In this embodiment, the offloading flowlines typically need not be insulated. The export carrier has a refrigeration system to liquefy the LPG for loading into the export tanks. The export tankers in this embodiment are suitable for carrying pressurized LPG. The export carriers have refrigeration facilities on board to re-liquefy any gasified LPG, which is produced in the offloading transfer lines during the offloading and transferring process and in the storage tanks during loading and travel. To receive the pressurized ambient temperature LPG, the carriers must be fitted with these refrigeration facilities to re-liquefy any gasified LPG and tanks suitable for storing pressurized LPG.

In this embodiment, after separation, the LPG is pressurized at ambient temperature on the floating or fixed processing facility (100). The processing facility (100) may also contain a storage unit for the LPG and the LPG may be stored on the processing facility in temporary storage tanks for a short period until the export carrier (300) arrives at the transfer station (200). A separate, intermediate FPSO unit for storing the LPG is not required. Offloading risers (10 and 20) and offloading flowlines on the seabed (30) are utilized.

In this embodiment, the pressurized LPG is circulated from the floating or fixed offshore processing facility (100) through the offloading riser (10) to the offloading flowline (30) at the seabed, up through the second subsea offloading riser (20) to the transfer station (200).

When an export carrier (300) arrives at the transfer station (200), the LPG can be delivered to the export carrier (300) through a suitable transfer hose (40). The transfer hose can be floating on or near the water surface or at a depth below the surface. In this embodiment, the transfer station can be a buoy.

In this embodiment, the temperature of the LPG in the subsea offloading risers and the subsea offloading flowlines is between about 5° F. and about 90° F. The pressure of the LPG in the subsea offloading risers and the subsea offloading flowline is between about 50 psia and about 350 psia.

In this embodiment, the system comprises a floating or fixed offshore processing facility (100), a floating or fixed offshore transfer station (200), a set of subsea offloading transfer lines (10, 20, and 30) connecting the processing facility and the transfer station. The set of subsea offloading transfer lines comprises at least two subsea offloading risers and at least one subsea offloading flowline connecting the processing facility and the transfer station. As illustrated, the set of subsea offloading transfer lines comprises an offloading flowline (30) connected between and in fluid communication with a first subsea offloading riser (10) and a second subsea offloading riser (20), the first subsea offloading riser (10) connected to and in fluid communication with the processing facility and the second subsea offloading riser (20) connected to and in fluid communication with the transfer station. In this embodiment, the offloading transfer lines need not be insulated.

While the invention has been described in detail and with reference to specific embodiments thereof, it will be apparent to one skilled in the art that various changes and modifications can be made without departing from the spirit and scope thereof.

What is claimed is:

1. A method of directly exporting liquefied petroleum gas (LPG) from an offshore location, comprising:

a) obtaining a mixture comprising oil and natural gas from a subsea well;

b) separating LPG from the mixture comprising oil and natural gas at a floating or fixed offshore processing facility;

c) offloading the LPG directly from the floating or fixed offshore processing facility by delivering the LPG from the processing facility through a first subsea offloading riser down to a seabed, through a subsea offloading flowline at the seabed, and up through a second subsea offloading riser to a floating or fixed offshore transfer station; and d) transferring the LPG from the transfer station to an export tanker at the transfer station, wherein an intermediate floating production, storage, and offloading (FPSO) unit between the processing facility and the export tanker is not required, and with the method further comprising circulating the LPG in the subsea offloading risers and the subsea offloading flowline until the export carrier arrives at the transfer station.

2. The method according to claim 1, further comprising refrigerating the LPG on the processing facility at low pressure prior to the offloading step.

3. The method according to claim 2, further comprising re-liquefying LPG in gas form on the export tanker.

4. The method according to claim 2, wherein the temperature of the LPG in the subsea offloading risers and the subsea offloading flowline is between about 5° F. and about 45° F.

5. The method according to claim 1, further comprising pressurizing the LPG at ambient temperature on the processing facility prior to the offloading step and refrigerating the LPG on the export tanker.

6. The method according to claim 5, further comprising storing the LPG on the processing facility until the export carrier arrives at the transfer station.

7. The method according to claim 5, wherein the temperature of the LPG in the subsea offloading risers and the subsea offloading flowline is between about 5° F. and about 90° F.

8. The method according to claim 1, wherein the pressure of the LPG in the subsea offloading risers and the subsea offloading flowline is between about 50 psia and about 350 psia.

9. The method according to claim 1, wherein offloading the LPG from the processing facility comprises delivering the LPG from the processing facility to a buoy located at a distance from the processing facility.

10. The method according to claim 9, wherein the transfer station is the buoy.

11. The method of claim 1, wherein the LPG is circulated through a set of first subsea offloading risers down to the seabed, through a set of subsea offloading flowlines at the seabed, and up through a set of second subsea offloading risers to the transfer station.

12. The method of claim 1, wherein the offloading risers and flowline are insulated.

13. The method of claim 12, wherein the offloading risers and flowline are jacket insulated.

14. The method of claim 12, wherein the offloading risers and flowline are vacuum insulated.

* * * * *